US005458553A

United States Patent [19]

Wu

[11] Patent Number: 5,458,553

[45] Date of Patent: Oct. 17, 1995

[54] FOLDABLE EXERCISE DEVICE

[76] Inventor: Tien-Lai Wu, 58, Ma Yuan West St., Taichung, Taiwan

[21] Appl. No.: 390,310

[22] Filed: Jan. 3, 1995

[51] Int. Cl.[6] ..... A63B 69/06

[52] U.S. Cl. ..... 482/95; 482/72; 482/57

[58] Field of Search ..... 482/71, 72, 95, 482/57, 96, 51, 111, 148; 472/106, 110; 280/1.182, 1.183, 1.192, 1.203, 1.204

[56] References Cited

U.S. PATENT DOCUMENTS

| | | | |
|---|---|---|---|
| 2,642,288 | 6/1953 | Bell | 482/95 |
| 4,300,760 | 11/1981 | Bobroff | 482/95 |
| 5,299,997 | 4/1994 | Chen | 482/72 |
| 5,342,269 | 8/1994 | Huang et al. | 482/95 |
| 5,356,358 | 10/1994 | Chen | 482/72 |
| 5,366,428 | 11/1994 | Liao | 482/72 |

FOREIGN PATENT DOCUMENTS

| | | | |
|---|---|---|---|
| 9218204 | 10/1992 | WIPO | 482/94 |

*Primary Examiner*—Stephen R. Crow
*Assistant Examiner*—Jerome Donnelly

[57] ABSTRACT

An exercise device includes an inclined beam. A seat post has a lower end pivotally coupled to the inclined beam and has a seat cushion secured on top. A lever is pivotally coupled to the upper end of the inclined beam and includes a handgrip and a pair of foot pedals. The lever includes two pins extended from the middle portion. A pair of links include one end pivotally coupled to the seat post and the other end having hooks for engaging with the pins so as to couple the seat post to the lever. The hooks are disengaged from the pins for folding the exercise device.

3 Claims, 5 Drawing Sheets

FOLDABLE EXERCISE DEVICE

BACKGROUND OF THE INVENTION

1. Field of the Invention

The present invention relates to an exercise device, and more particularly to a foldable horse-riding type exercise device.

2. Description of the Prior Art

Typical horse-riding type exercise devices comprise a seat and a handle having a pair of foot pedals secured to the bottom portion. The seat may be moved upward and downward when the handle and/or the foot pedals are pulled or stepped so as to simulate horse-riding exercises. However, the exercise devices may not be folded.

The present invention has arisen to mitigate and/or obviate the afore-described disadvantages of the conventional exercise devices.

SUMMARY OF THE INVENTION

The primary objective of the present invention is to provide a horse-riding type exercise device which may be folded to a compact configuration.

In accordance with one aspect of the invention, there is provided an exercise device comprising a first inclined beam including a rear and upper portion, a second inclined beam including a middle portion secured to the rear and upper portion of the first inclined beam and including an upper and front end, a seat post including a lower end pivotally coupled to the middle portion of the second inclined beam and including an upper end having a seat cushion secured thereon, a lever pivotally coupled to the upper and front end of the second inclined beam and including a handgrip provided on top thereof, the lever including a lower end and a middle portion having pin means extended therefrom, a pair of foot pedals secured to the lower end of the lever, and link means including a first end pivotally coupled to the seat post and a second end having hook means provided thereon for engaging with the pin means of the lever so as to couple the seat post to the lever, the hook means being disengaged from the pin means for folding the exercise device.

The first inclined beam includes a stop means provided thereon for engaging with the lower end of the lever so as to limit movement of the lever.

The lever includes an upper portion having an extension slidably engaged therein and includes a knob means provided on the upper portion for securing the extension to the lever so as to adjust the extension relative to the lever, the handgrip is secured on top of the extension.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
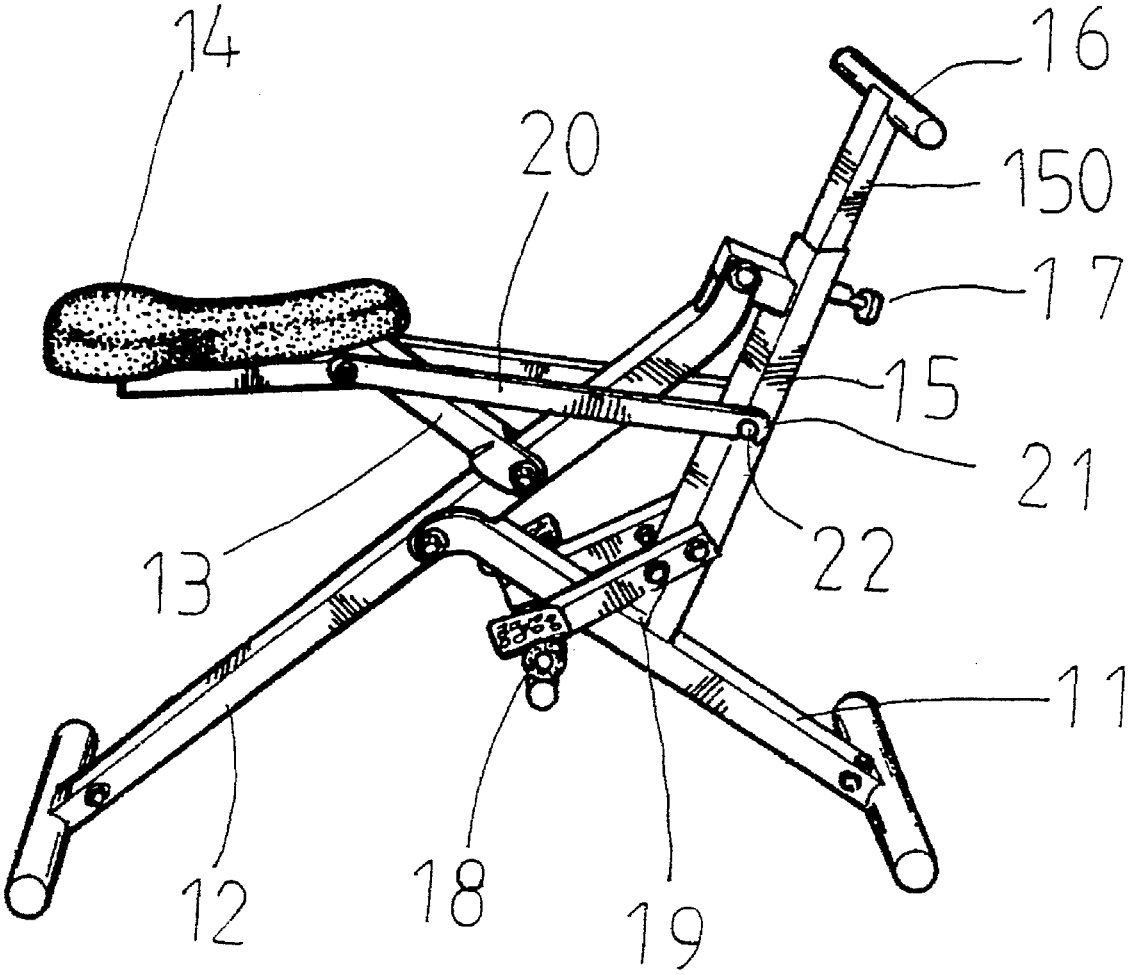
FIG. 1 is a perspective view of an exercise device in accordance with the present invention.

Referring to the drawings, and initially to FIG. 1, an exercise device in accordance with the present invention comprises a first inclined beam 11 including a stop 19 provided thereon, a second inclined beam 12 having a middle portion secured to the upper end of the first inclined beam 11. A seat post 13 includes a lower end pivotally coupled to the middle portion of the second inclined beam 12 and includes a seat cushion 14 secured on the upper end thereof. A lever 15 includes an upper end pivotally coupled to the upper end of the second inclined beam 12 and includes an extension 150 slidably engaged on top thereof. A handgrip 16 is provided on top of the extension 150. A knob 17 is provided on top of the lever 15 for securing the extension 150 to the lever 15 and for adjusting the position of the handgrip 16. A pair of foot pedals 18 are secured to the bottom portion of the lever 15. The stop 19 may engage with the bottom end of the lever 15 for limiting movement of the lever 15.

Figure 5:
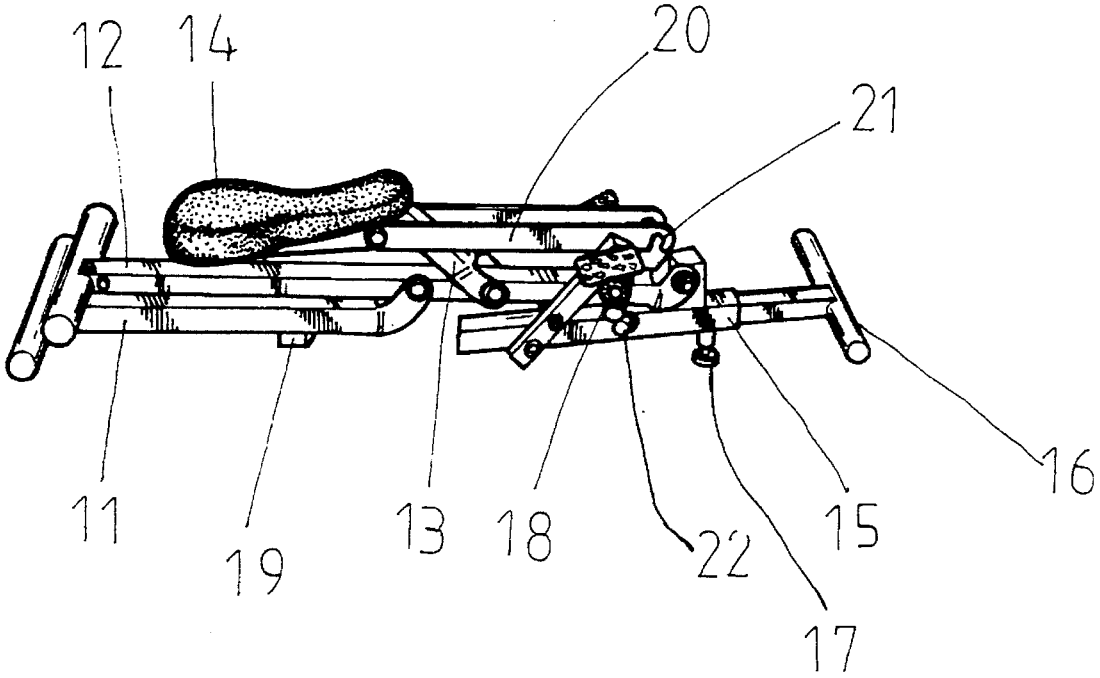
FIG. 5 is a perspective view illustrating the folded configuration of the exercise device.

As best shown in FIGS. 1 and 5, the lever 15 includes a pair of pins 22 laterally extended outward therefrom. A pair of links 20 include one end pivotally coupled to the seat post 13 and include hooks 21 formed on the other end for engaging with the pins 22 of the lever 15 so as to couple the seat post 13 to the lever 15. When the hooks 21 are disengaged from the pins 22, the exercise device may be easily folded to a folded configuration as shown in FIG. 5. However, when the hooks 21 are engaged with the pins 22, the exercise device can be used as a horse-riding type exercise.

Figure 2:
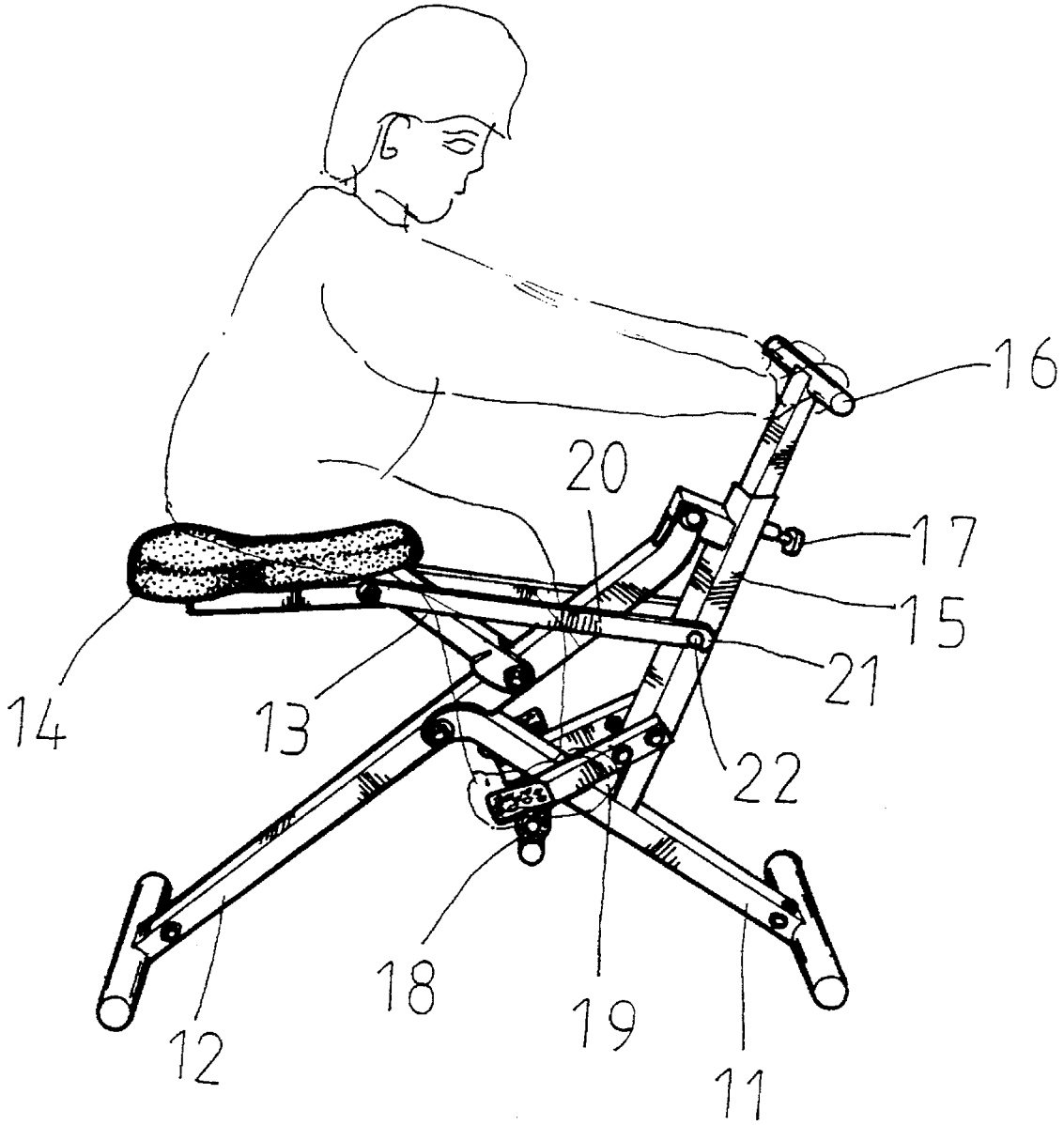
FIGS. 2, 3 and 4 are perspective views illustrating the operation of the exercise device.
Figure 3:
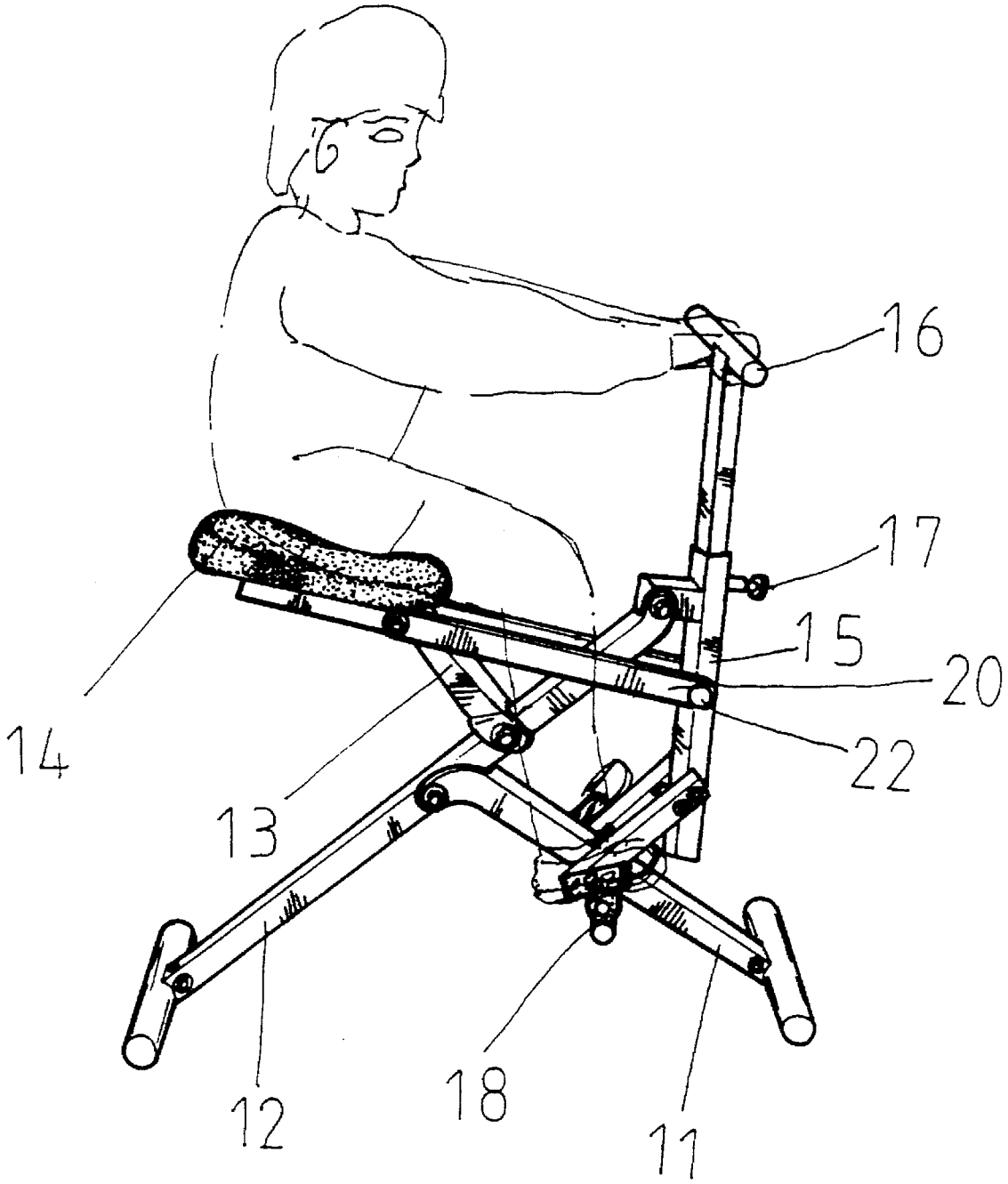
Figure 4:
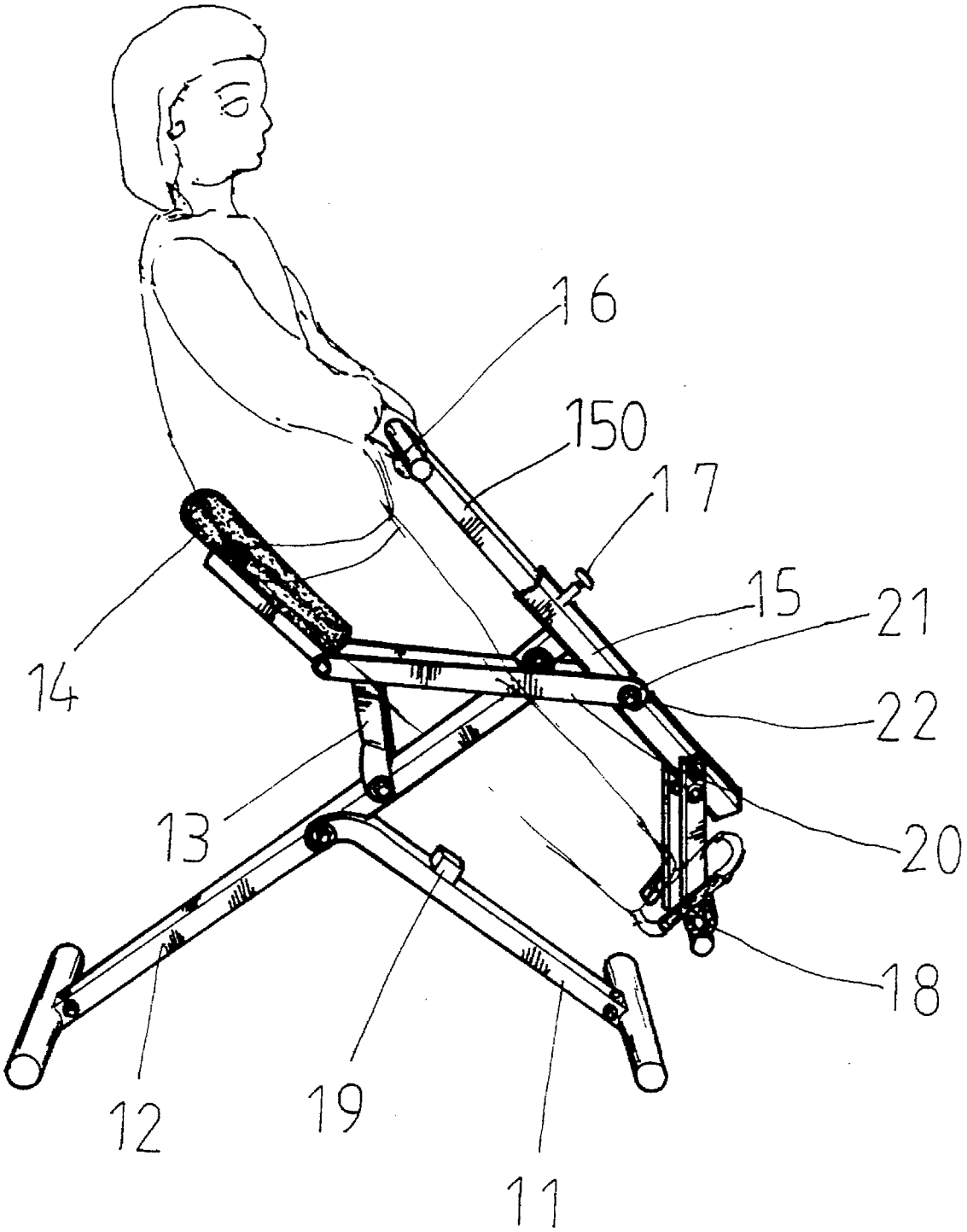

In operation, as shown in FIGS. 2 to 4, when the handgrip 16 is pulled and/or when the foot pedals 18 are depressed, the exercise device may simulate horse-riding exercise.

Accordingly, the exercise device in accordance with the present invention includes a configuration that may be folded to a compact configuration for transportation and for storing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise device comprising:

a first inclined beam including a front and lower portion and a rear and upper portion, a second inclined beam including a middle portion secured to said rear and upper portion of said first inclined beam and including an upper and front end, a seat post including a lower end pivotally coupled to said middle portion of said second inclined beam and including an upper end having a seat cushion secured thereon, a lever pivotally coupled to said upper and front end of said second inclined beam and including a handgrip provided on top thereof, said lever including a lower end and a middle portion having pin means extended therefrom, a pair of foot pedals secured to said lower end of said lever, and link means including a first end pivotally coupled to said seat post and a second having hook means provided thereon for engaging with said pin means of said lever so as to couple said seat post to said lever, said hook means being disengaged from said pin means for folding said exercise device.

2. An exercise device according to claim 1, wherein said first inclined beam includes a stop means provided thereon for engaging with said lower end of said lever so as to limit movement of said lever.

3. An exercise device according to claim 1, wherein said lever includes an upper portion having an extension slidably engaged therein and includes a knob means provided on said upper portion for securing said extension to said lever so as to adjust said extension relative to said lever, said handgrip is secured on top of said extension.

* * * * *